US007422417B2

(12) United States Patent
Landis

(10) Patent No.: US 7,422,417 B2
(45) Date of Patent: Sep. 9, 2008

(54) AIRFOIL WITH A POROUS FIBER METAL LAYER

(75) Inventor: Kenneth K. Landis, Tequestra, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 685 days.

(21) Appl. No.: 11/140,059

(22) Filed: May 27, 2005

(65) Prior Publication Data

US 2006/0251515 A1 Nov. 9, 2006

Related U.S. Application Data

(60) Provisional application No. 60/677,901, filed on May 5, 2005, provisional application No. 60/677,900, filed on May 5, 2005.

(51) Int. Cl.
*F01D 5/18* (2006.01)

(52) U.S. Cl. ..... 416/1; 416/241 R; 416/241 B; 416/230; 416/229 A

(58) Field of Classification Search ..... 416/241 R, 416/241 B, 1, 230, 229 A
See application file for complete search history.

(56) References Cited

U.S. PATENT DOCUMENTS 3,619,082 A 11/1971 Meginnis
4,075,364 A 2/1978 Panzera
4,338,380 A 7/1982 Erickson et al.
4,629,397 A 12/1986 Schweitzer
5,605,045 A * 2/1997 Halimi et al. ..... 60/607
6,451,377 B1 * 9/2002 Paul et al. ..... 427/226
6,599,568 B2 * 7/2003 Lee et al. ..... 427/230
7,246,993 B2 * 7/2007 Bolms et al. ..... 415/116

* cited by examiner

*Primary Examiner*—Ninh H Nguyen
(74) *Attorney, Agent, or Firm*—John Ryznic

(57) ABSTRACT

An air cooled airfoil for use in a gas turbine engine includes a base, a porous material on the base, and a thermal barrier coating (TBC) applied to the porous material, with cooling holes in the base and the TBC to allow for cooling air to flow from within the airfoil to the surface of the airfoil, and where the porous material has a higher density near the TBC interface than at the base interface. The higher density at the TBC interface provides for a rigid support structure for the TBC as well as higher heat transfer than would the lower density porous material near the base, the lower density porous material near the base acting to reduce heat transfer to the base and therefore promote heat transfer into the cooling air passing through the porous material and out onto the airfoil surface. An additional embodiment includes an airfoil having a plurality of outward facing cavities, each cavity being filled with a porous material having varying density and covered with a TBC layer.

24 Claims, 2 Drawing Sheets

AIRFOIL WITH A POROUS FIBER METAL LAYER

CROSS-REFERENCE TO RELATED APPLICATIONS

This application is related to and claims priority to U.S. Provisional Application Ser. No. 60/677,901 filed on May 5, 2005 and entitled Airfoil with a Porous Fiber Metal Layer, and to U.S. Provisional Application Ser. No. 60/677,900 filed on May 5, 2005 and entitled Airfoil having porous metal filed cavities.

STATEMENT REGARDING FEDERALLY SPONSORED RESEARCH OR DEVELOPMENT

None apply.

INCORPORATION-BY-REFERENCE OF MATERIAL SUBMITTED ON A COMPACT DISC

None apply.

REFERENCE TO A MICROFICHE APPENDIX

None apply.

BACKGROUND OF THE INVENTION

1. Field of the Invention

The present invention relates to an airfoil used in a gas turbine engine, either as a rotary blade or a stationary vane, where the metal airfoil includes a layer of a porous foam metal material which varies in density in order to promote heat transfer from the airfoil surface to the fiber metal material, and includes a thermal barrier coating applied on top of the porous foam metal.

2. Description of the Related Art Including Information Disclosed Under 37 CFR 1.97 and 1.98

Airfoils used in gas turbine engines have used porous metal materials placed between a base metal of the airfoil and a thermal barrier coating to improve heat transfer and cooling of the airfoil. Many types of ceramic and metal porous materials have been used. None, as far as the inventor of the present invention is aware of, disclose the foam material to have varying density.

U.S. Pat. No. 3,619,082 issued to Meginnis on Nov. 9, 1971 shows a turbine rotor blade of laminated porous metal cast into a base and includes an inner reinforcing layer which has increased porosity in the direction span wise of the blades so that the strength diminishes with load in the span wise direction and the porosity provides for flow of air to the porous blade wall. Pores or relieved areas in some sections of some layers are elongate and disposed with their long dimension span wise of the blade for increased strength in direction, in which stress in the blade is greatest. The Meginnis invention does not have variable density porous metal fiber material.

U.S. Pat. No. 4,629,397 issued to Schweitzer on Dec. 16, 1986 shows a gas turbine blade which is coolable for use under high thermal load conditions, has a metallic support core with cooling ducts separated by lands in its surface. The core and its cooling ducts and lands are enclosed by an inner layer of metal felt and an outer layer of heat insulating ceramic material which partially penetrates into the metal felt to form a bonding zone between the felt and the ceramic material. Thus, any heat passing through the ceramic layer is introduced into the large surface area of the metal felt enabling the latter to efficiently introduce the heat into a cooling medium flowing in the ducts, thereby preventing thermal loads from adversely affecting the metal core to any appreciable extent. The Schweitzer invention does not have variable density porous metal fiber material.

U.S. Pat. No. 4,075,364 issued to Panzera on Feb. 21, 1978 and U.S. Pat. No. 4,338,380 issued to Erickson et al on Jul. 6, 1982 show turbine blades with a porous fiber metal applied to a base of the blade, and a thermal barrier coating applied to the porous metal, but the density of the porous metal does not vary.

BRIEF SUMMARY OF THE INVENTION

The present invention is an airfoil for use in a gas turbine engine, where the airfoil requires passing cooling air through the airfoil to prevent thermal damage to the airfoil caused by the high heat load. The airfoil is formed of a base material and includes cooling holes strategically located in the base. A fiber metal layer is bonded to the base material, and a thermal barrier coating is bonded to the fiber metal. The density of the fiber metal is lower at the fiber metal/base bond and the density is higher at the fiber metal/TBC bond. The higher density porous foam metal at the TBC interface provides for a rigid support structure for the TBC as well as a greater conductive heat transfer rate from the TBC to the porous foam metal material underneath. The lower density of foam metal at the base interface provides for a lower conductive heat transfer rate. The foam metal acts to accumulate the heat and transfer the stored heat to the cooling air passing through. Holes in the TBC allow for the cooling air to flow into the gas stream of the turbine and cool the airfoil.

In a second embodiment of the present invention, an airfoil includes a plurality of cavities facing in an outward direction of the airfoil, the cavities being filed with a porous material having varying density, where the density near the base or bottom of the cavity is lower than the density near the opening of the cavity, and a TBC layer is applied over the porous material for form an airfoil surface. Cooling holes located in the base and in the TBC allow for a cooling fluid to flow through the porous material an onto the TBC.

DETAILED DESCRIPTION OF THE INVENTION

Figure 1:
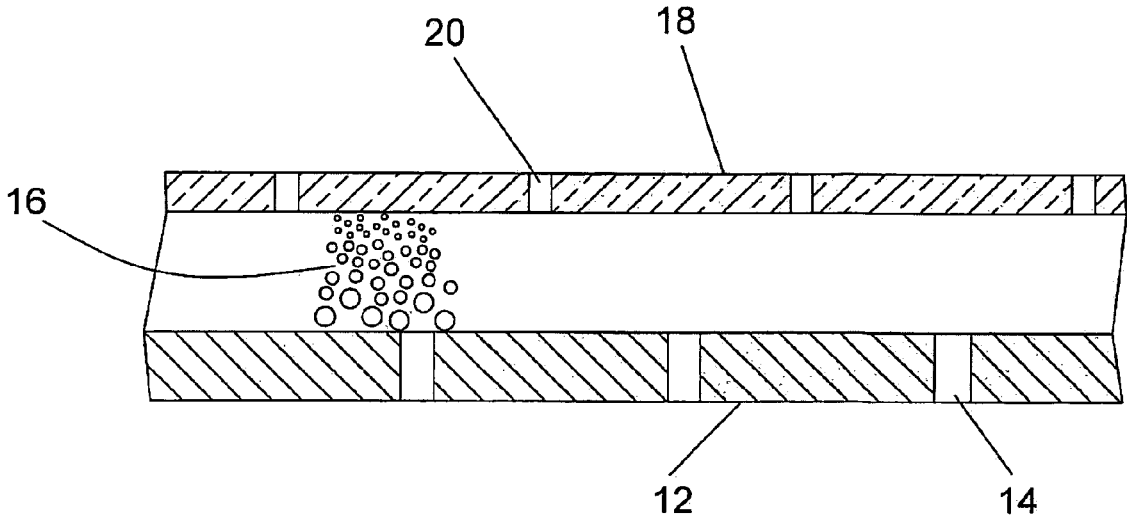
FIG. 1 shows a section of an airfoil having a base member with the porous fiber metal layer on the base, and a TBC layer on the fiber metal.

The present invention is an airfoil for use in a gas turbine engine, either for a rotary blade or a stationary vane. The airfoil includes a base material of either a metal alloy, ceramic or ceramic matrix composite material. FIG. 1 shows a section of the airfoil having the fiber metal layer and TBC that forms the present invention. The airfoil includes a base 12 having cooling holes 14 therein to allow cooling air to flow from a central portion of the airfoil to the outer surface for cooling purposes. A porous fiber metal material 16 is bonded to the base 12, the fiber metal material being of any of the well-known materials used for airfoils in gas turbine engines, and the bonding method being any of the well known methods for bonding fiber metals to a metallic or ceramic base. A thermal barrier coating (TBC) 18 is bonded to the fiber metal layer, and includes cooling holes 20 to pass the cooling air onto an external surface of the airfoil for cooling. The TBC layer can be any of the well known TBCs used on airfoils in a gas turbine engine.

The cooling holes 14 in the base 12 are not aligned with the cooling holes 20 of the TBC in order to force the cooling air to flow through as much of the fiber metal material as possible. This increases the heat transfer rate from the fiber material to the cooling air, since the cooling air remains in contact with the fiber metal material for a longer period of time.

The main feature of the present invention is the varying density of the fiber metal layer. As shown in FIG. 1, the density of the fiber metal 16 is higher at the interface to the TBC 18. This promotes the heat transfer from the TBC to the foam metal material. This higher density at the TBC bond interface also provides a more rigid support for the TBC layer. The density of the fiber metal 16 at the base 12 interface is lower, and this acts to decrease the heat transfer from thee fiber metal 16 to the base material 12. Because of the varying density of the fiber metal, more heat is transferred to the cooling air passing through the fiber metal 16 than would be transferred if the density did not vary.

In operation, a high temperature gas stream in the turbine acts on the airfoil surface on which the TBC layer 18 and the fiber metal 16 is located. Heat transfers to the TBC and to the higher density fiber metal 16 at a higher rate than heat transfer at the base 12 and lower density fiber metal interface. Because of the cooling air flowing through the cooling holes 14 and through the fiber metal 16, more heat is transferred to the cooling air than would be if the density of the fiber metal was constant. Therefore, the base metal of the airfoil remains at a lower temperature because more heat is transferred in the cooling air and out the cooling holes 20 in the TBC layer 18.

Figure 2:
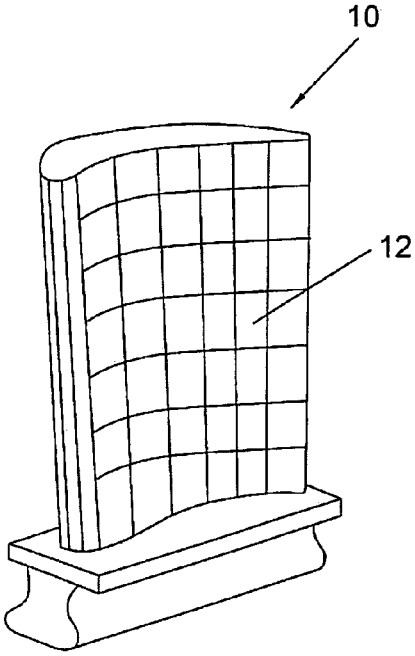
FIG. 2 shows an airfoil having a plurality of cavities facing outward from the airfoil.
Figure 3:
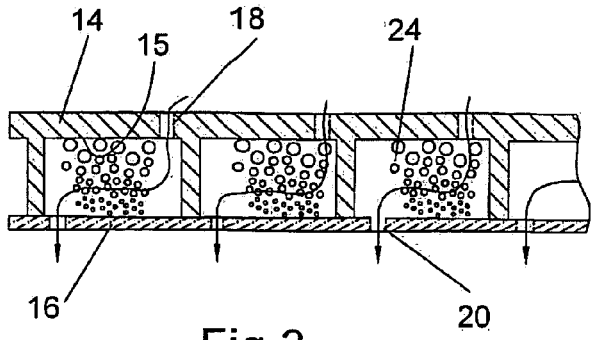
FIG. 3 shows a cross section view of an airfoil having a plurality of cavities, each cavity being filled with a porous material having a varying density.
Figure 4:
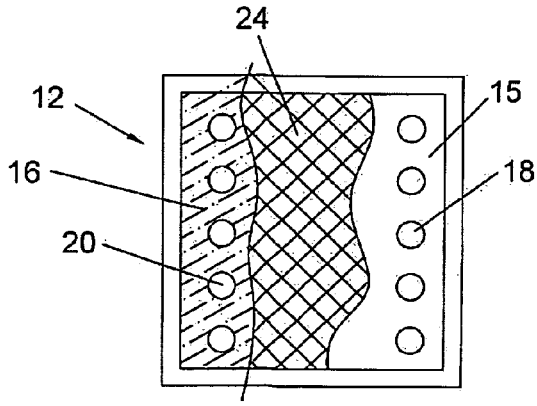
FIG. 4 shows a top view of a single cavity with a portion showing the base of the cavity with cooling holes, a portion showing the porous material, and a portion showing the TBC with cooling holes.

In a second embodiment of the present invention represented in FIGS. 2 through 4, the airfoil includes a plurality of cavities facing outward from the airfoil. The cavities can be square shaped, rectangular shaped, triangular shaped, oval shaped, or any shape desired. Each cavity 12 is filled with a porous material 24, with the porous material increasing in density from the base to the surface on which the TBC layer 16 is applied. the base 15 includes cooling holes 18 located on one side of the cavity 12, while the TBC includes cooling holes 20 located on an opposite side of the cavity to force the cooling air to pass through as much of the porous material as possible, thereby enhancing the heat transfer from the porous material to the cooling air as described above in the first embodiment. The cavities can be located on the airfoil where needed in order to provide extra cooling.

What is claimed is:

1. An airfoil for use in a gas turbine engine, comprising:

a base, the base having a plurality of cooling holes to supply a cooling fluid to an external surface of the airfoil;

a porous material applied to the base;

the porous material being a porous fiber metal;

a thermal barrier coating applied to the porous material, the thermal barrier coating having a plurality of cooling holes therein to discharge the cooling fluid onto the external surface of the airfoil; and, the porous material having a density that varies from the base to the thermal barrier coating.

2. The airfoil of claim 1, and further comprising:

the porous material having a greater density in the half at the thermal barrier coating than in the half at the base.

3. The airfoil of claim 2, and further comprising:

the porous material being a porous ceramic material.

4. The airfoil of claim 2, and further comprising:

the porous material being a porous ceramic matrix composite material.

5. An airfoil for use in a gas turbine engine, the airfoil comprising:

a base, the base having a plurality of cooling holes to supply a cooling fluid to an external surface of the airfoil;

porous material means applied to the base;

the porous material means being a porous fiber metal means;

a thermal barrier coating applied to the porous material means, the thermal barrier coating having a plurality of cooling holes therein to discharge the cooling fluid onto the external surface of the airfoil; and, the porous material means having a density that varies from the base to the thermal hauler coating.

6. The airfoil of claim 5, and further comprising:

the porous material means having a greater density in the half at the thermal barrier coating than in the half at the base.

7. The airfoil of claim 6, and further comprising:

the porous material means being a porous ceramic material means.

8. The airfoil of claim 6, and further comprising:

the porous material means being a porous ceramic matrix composite material means.

9. A process for cooling an airfoil used in a gas turbine engine, the airfoil having a base with a plurality of cooling holes therein and a thermal barrier coating having a plurality of cooling holes therein, the process comprising the steps of:

providing for a porous material located between the base and the thermal barrier coating;

providing for the porous material to be a porous fiber metal material; and, providing for the density of the porous material to be greater near the thermal barrier coating than near the base.

10. The process for cooling an airfoil of claim 9, and further comprising the step of:

providing for the porous material to be a porous ceramic material.

11. The process for cooling an airfoil of claim 9, and further comprising the step of:

providing for the porous material to be a porous ceramic matrix composite material.

12. An airfoil for use in a gas turbine engine, the airfoil comprising:

a plurality of cavities, each cavity having an opening facing an outward direction of the airfoil, each cavity having a base;

a porous material filling the cavities, the porous material having a varying density;

a thermal barrier coating applied on top of the porous material;

cooling holes located in the base and the TBC to allowing for a cooling fluid to flow through the porous material and cool the airfoil.

13. The airfoil of claim 12, and further comprising:
the porous material having a higher density near the TBC than near the base.

14. The airfoil of claim 12, and further comprising:
the cooling holes located in the base are located on one side of the cavity, and the cooling holes located in the TBC are located on an opposite side of the cavity.

15. The airfoil of claim 12, and further comprising:
the porous material being a porous fiber metal.

16. The airfoil of claim 12, and further comprising:
the porous material being a porous ceramic material.

17. The airfoil of claim 12, and further comprising:
the porous material being a porous ceramic matrix composite material.

18. An. airfoil for use in a gas turbine engine, comprising:
a base, the base having at least one cooling hole to supply a cooling fluid to an external surface of the airfoil;
a porous material applied to the base;
a thermal barrier coating applied to the porous material, the thermal barrier coating having a plurality of cooling holes therein to discharge the cooling fluid onto the external surface of the airfoil; and,
the porous material being a single composition and having a density that varies from the base to the thermal barrier coating.

19. The airfoil of claim 18, and further comprising:
The density of the porous material increases in the direction toward the TBC.

20. The airfoil of claim 18, and further comprising:
The porous material is a porous fiber metal.

21. The airfoil of claim 18, and further comprising:
The porous material being a porous ceramic material.

22. The airfoil of claim 18, and further comprising:
The porous material being a porous ceramic matrix composite material.

23. The airfoil of claim 18, and further comprising:
The airfoil including a plurality of cavities formed by ribs on the sides of each cavity and a base on the bottom of each cavity;
At least one cooling hole in the base for each cavity;
Each cavity being substantially filled with the porous material; and,
The TBC applied over the TBC to form the airfoil external surface.

24. The airfoil of claim 23, and further comprising:
The plurality of cavities are formed in an array on the pressure side of the airfoil.

* * * * *